United States Patent [19]

Ginatta

[11] Patent Number: 4,925,543

[45] Date of Patent: May 15, 1990

[54] INSOLUBLE ANODES FOR EXTRACTING LEAD FROM THE ELECTROLYTE IN ELECTROCHEMICAL PROCESSES FOR RECOVERING THE METALS CONTAINED IN SPENT ACCUMULATIONS

[75] Inventor: Marco Ginatta, Turin, Italy

[73] Assignee: Snamprogetti S.p.A., Milan, Italy

[21] Appl. No.: 788,656

[22] Filed: Oct. 16, 1985

Related U.S. Application Data

[63] Continuation-in-part of Ser. No. 676,611, Dec. 3, 1984, abandoned, which is a continuation of Ser. No. 493,629, May 11, 1983, abandoned.

[30] Foreign Application Priority Data

May 27, 1982 [IT] Italy ..... 21509 A/82

[51] Int. Cl.[5] ..... C25B 11/00

[52] U.S. Cl. ..... 204/288; 204/114

[58] Field of Search ..... 204/66, 114, 286, 288, 204/294, 292

[56] References Cited

U.S. PATENT DOCUMENTS

| | | | |
|---|---|---|---|
| 1,002,462 | 9/1911 | Sibley | 204/286 |
| 1,206,963 | 12/1916 | Whitehead | 204/286 |
| 1,836,368 | 12/1931 | Eppensteiner et al. | 204/286 |
| 1,892,413 | 12/1932 | Teats et al. | 204/286 |
| 3,298,945 | 1/1967 | Weis et al. | 204/286 |
| 3,530,047 | 9/1970 | Billett | 204/286 |
| 4,014,763 | 3/1977 | Lowe | 204/286 |
| 4,096,045 | 6/1978 | Ahonen et al. | 204/114 |
| 4,186,074 | 1/1980 | Perry | 204/286 |
| 4,447,307 | 5/1984 | Davis et al. | 204/286 |

*Primary Examiner*—John F. Niebling
*Assistant Examiner*—Kathryn Gorgos
*Attorney, Agent, or Firm*—Morgan & Finnegan

[57] ABSTRACT

A special system is described and illustrated for supporting and easily maneuvering, without the danger of breakage, a set of graphite anodes used for extracting the lead from the electrolyte in electrochemical processes for recovering the metals contained in spent accumulators.

3 Claims, 1 Drawing Sheet

INSOLUBLE ANODES FOR EXTRACTING LEAD FROM THE ELECTROLYTE IN ELECTROCHEMICAL PROCESSES FOR RECOVERING THE METALS CONTAINED IN SPENT ACCUMULATIONS

BACKGROUND OF THE INVENTION

This is a continuation in part of U.S. patent application Ser. No. 676,611, filed Dec. 3, 1984, now abandoned, which is a continuation of U.S. patent application Ser. No. 493,629, filed May 11, 1983, which is now abandoned.

This invention relates to a special constructional system for the insoluble graphite anodes used for extracting lead from the electrolyte in electrochemical processes for recovering the metal contained in spent accumulators. Said system enables several anodes to be supported and easily and simultaneously maneuvered without the danger of breakage during the immersion or extraction of the anodes into or from the tanks containing the electrolyte in which the lead has been dissolved.

BRIEF DESCRIPTION OF THE DRAWINGS

For a fuller understanding of the invention, reference is had to the following detailed description taken in connection with the accompanying drawings of preferred embodiments in which.

DETAILED DESCRIPTION OF PREFERRED EMBODIMENT

Figure 1:
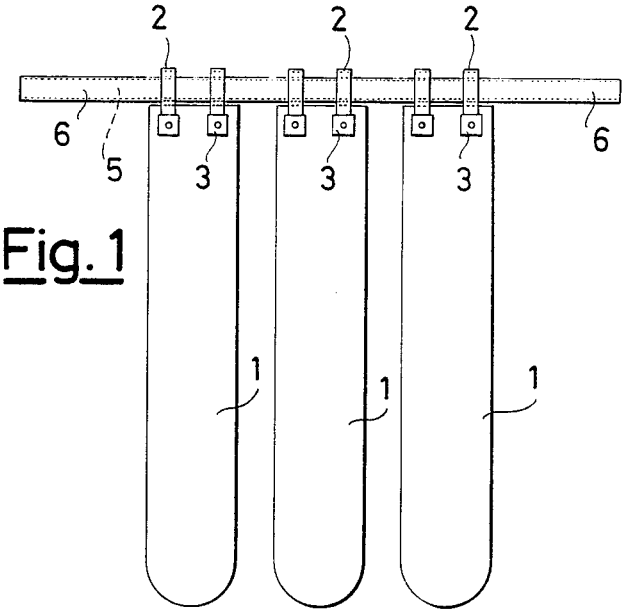
FIG. 1 is a front view of the anode system according to the invention.
Figure 3:
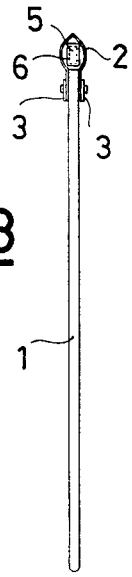
FIG. 3 is a side view of the anode system of the present invention.
Figure 2:
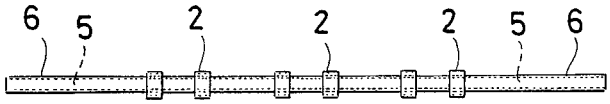
FIG. 2 is a top view of the anode system of the present invention.

The invention is described hereinafter with reference to the above said figures. By way of example, FIG. 1 shows three anodes 1, but these can be of any number. Each anode is in the form of a parallelepiped plate, which is rounded at its bottom end, and is provided at its top with one or more support strips of copper 2 (or other conducting material) of the form shown in FIGS. 3 and 4. Said support strips, which are bent over on to two major sides of the anode so as to leave an annular space above said anode, are clamped and kept adhering to the two faces of the anode by pairs of plates 3 fixed by bolts 4 and nuts 7, as shown in the detail of FIG. 4.

The anodes prepared in this manner are suspended from a current carrying steel tube 5 of square, circular or polygonal cross section clad with copper sheet 6, the tube being inserted into the annular spaces formed by the copper support strips 2.

The anode system formed in this manner can be easily maneuvered as required by using an overhead travelling crane or other lifting and transportation equipment, and the electrical connection to all the anodes is made by connecting the copper clad tube to the direct current power supply.

Figure 4:
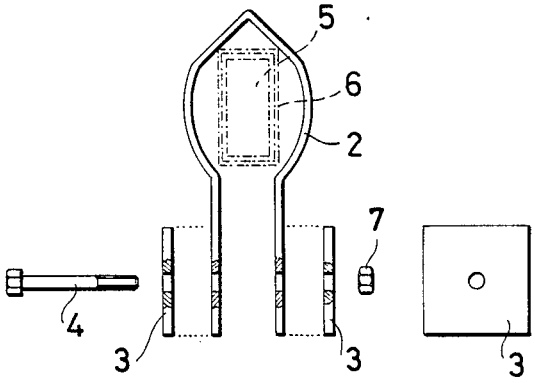
FIG. 4 is a detailed sectional view of the upper part of a suspended anode as shown in FIG. 3.

As shown in FIG. 4, the electrical contact between current carrying steel tube 5 and each copper support strip 2 takes place only along two points due to the inverted V-shape of copper support strip 2. This arrangement provides a space between each bottom lateral end of current carrying steel tube 5 and copper support strip 2 thereby allowing graphite anode 1 to swing from side-to-side due to oscillations in the electrolyte and, at the same time, preventing uninhibited movement thereof, which would result in damage to graphite anode 1 during operation.

In operation of the invention, anodes 1 are suspended in an electrolytic bath by connecting anodes 1 directly to inverted V-shaped copper support strips 2 which suspend from and contact steel tube 5 in only two points. When current is supplied to steel tube 5, anodes 1 swing due to oscillations of the electrolyte. As anodes 1 begin to swing, movement thereof is inhibited as support strips 2 contact the bottom lateral ends of steel tube 5.

In this manner, support strips 2 allow the use of brittle graphite anodes 1 despite the oscillations of the electrolyte, without causing any damage thereto.

Since the construction and the advantages of the present invention may be readily understood from the foregoing embodiment, further explanation is believed to be unnecessary. However, since numerous modifications will readily occur to those skilled in the art from the foregoing specification and accompanying drawings, it is not intended that the invention be limited to any particular embodiment disclosed herein, but variations, modifications and equivalents may be made therefrom which fall within the scope of the appended claims.

What is claimed is:

1. An insoluble graphite anode system for extracting lead from an electrolyte in electrochemical processes and for recovering metals contained in spent accumulators comprising a plurality of graphite anodes having the form of parallelepiped plates rounded at their bottom end, said anodes having at their top end one or more copper strips bent over to contact said anodes so as to leave an annular space above each of said anodes, each copper strip having a semicircular shape at its mid-section and an inverted V-shape at its top-section, said copper strip being clamped adjacent to said anode by a pair of plates which is removably secured to said copper strip, said annular spaces formed by said copper strips clamped to the top end of said anodes having a steel tube of polygonal cross-section passing therethrough and contacting said copper strips along two points, said anodes being suspended from said steel tube, said steel tube being clad with sheet copper.

2. A system as defined in claim 1 in which said pair of plates is removably secured to said copper strip by a nut and bolt.

3. A system as defined in claim 1 in which said steel tube has a square cross-section.

* * * * *